US010424173B1

(12) United States Patent
Bien

(10) Patent No.: US 10,424,173 B1
(45) Date of Patent: Sep. 24, 2019

(54) LIGHTED PILING CAP

(71) Applicant: Franklin Bien, Englewood, FL (US)

(72) Inventor: Franklin Bien, Englewood, FL (US)

( * ) Notice: Subject to any disclaimer, the term of this patent is extended or adjusted under 35 U.S.C. 154(b) by 0 days.

(21) Appl. No.: 15/920,402

(22) Filed: Mar. 13, 2018

Related U.S. Application Data

(63) Continuation-in-part of application No. 29/640,209, filed on Mar. 12, 2018.
(Continued)

(51) Int. Cl.
*G08G 3/00* (2006.01)
*G08B 5/38* (2006.01)
(Continued)

(52) U.S. Cl.
CPC ..... *G08B 5/38* (2013.01); *F21S 9/037* (2013.01); *F21V 3/02* (2013.01); *F21V 23/0407* (2013.01);
(Continued)

(58) Field of Classification Search
CPC ..... H05B 37/0272; H05B 37/0227; H05B 33/0854; H05B 33/0803; H05B 37/0281; H05B 33/0872; H05B 37/0218; H05B 33/0809; H05B 33/0845; H05B 37/03; H05B 33/0815; H05B 33/0857; H05B 33/089; H05B 33/0842; Y02B 10/72; Y02B 20/383; Y02B 20/346; Y02B 20/348; Y02B 20/44; Y02B 20/48; Y02B 20/42; H02J 9/02; H02J 9/065; H02J 7/34; H02J 7/0068; H02J 7/345; H02J 9/061; H02J 13/0017; H02J 50/00; H02J 50/10; H02J 50/40; H02J 7/025; H02J 3/00; Y10T 307/359; Y10T 307/625; Y10T 307/344; Y10T 307/615; Y10T 307/505; Y10T 307/696; F21S 9/022; F21S 2/00; F21S 8/033; F21S 8/04; F21S 9/037; F21S 8/00; F21S 9/02; F21Y 2115/10; F21Y 2115/15; F21Y 2101/00; F21V 23/0442; F21V 33/0072; F21V 17/02; F21V 21/0824; F21V 21/30; F21V 23/0435; F21V 23/0471; F21V 31/00; F21W 2111/027; F21W 2111/00;
(Continued)

(56) References Cited

U.S. PATENT DOCUMENTS 3,801,022 A * 4/1974 Cassey ..... F21S 8/00 362/257
3,835,651 A * 9/1974 Butterworth ..... E02B 3/02 405/30

(Continued)

*Primary Examiner* — Daniel Previl
(74) *Attorney, Agent, or Firm* — Daniel S. Polley, P.A.

(57) ABSTRACT

A lighted piling cap that is preferably solar powered and which serves as a cap/marker for another water borne or water related structure. The device can serve as a nighttime marker to alert boaters of decks, docks, waterway obstructions, etc. that may not be visible during nighttime travels. The device includes a solar powered lighting element for nighttime visibility which can be a plurality of LED light bulbs. The outer enclosure can be constructed from a rugged and/or seaworthy material, to allow it to be able to preferably withstand the harsh environment of fresh and saltwater coastlines. The device preferably includes a sealed Lithium polymer battery, with flash, strobing and/or "on" modes and an automatic sunset on, sunrise off sensor.

22 Claims, 8 Drawing Sheets

Related U.S. Application Data

(60) Provisional application No. 62/470,615, filed on Mar. 13, 2017.

(51) Int. Cl.

| | |
|---|---|
| ***F21V 3/02*** | (2006.01) |
| ***F21S 9/03*** | (2006.01) |
| ***F21V 23/04*** | (2006.01) |
| *E02B 3/06* | (2006.01) |
| *F21Y 115/10* | (2016.01) |
| *F21W 131/10* | (2006.01) |

(52) U.S. Cl.
CPC ..... *F21V 23/0464* (2013.01); *E02B 3/06* (2013.01); *F21W 2131/10* (2013.01); *F21Y 2115/10* (2016.08)

(58) Field of Classification Search
CPC ..... F21W 2131/401; Y10S 362/806; Y10S 362/80; F21K 9/23; F21K 9/238; H02H 3/08; H02H 3/20; H04L 67/10; A61G 2205/50; A61G 7/00; A61G 7/012; A61G 7/015; A61G 7/05; A61G 7/0506; A61G 7/0507; A61G 7/0528; E04F 2011/1048; H01Q 1/248; H01Q 1/44; B60Q 1/0483; B60R 1/008; B63H 9/04; G01P 13/02; G01P 1/08; G02B 6/0006
USPC ..... 340/984, 604, 573.1, 539.11, 568.2, 340/679–680, 825.49, 306, 815.45
See application file for complete search history.

(56) References Cited

U.S. PATENT DOCUMENTS

| | | | | | |
|---|---|---|---|---|---|
| 4,892,445 | A * | 1/1990 | Paige | E02D 7/00 | 405/195.1 |
| 5,408,221 | A * | 4/1995 | Carsella, Sr. | B63B 35/816 | 116/173 |
| 5,477,424 | A * | 12/1995 | Mocha | B63H 9/04 | 362/477 |
| 5,537,299 | A * | 7/1996 | Perry | B60Q 1/0483 | 362/20 |
| 8,672,505 | B1 * | 3/2014 | Hogan | F21S 9/037 | 362/182 |

* cited by examiner

LIGHTED PILING CAP

This application is a continuation-in-part of U.S. application Ser. No. 29/640,209, filed Mar. 12, 2018 and also claims the benefit of and priority to U.S. application Ser. No. 62/470,615, filed Mar. 13, 2017, both applications are incorporated by reference in their entireties for all purposes.

1. FIELD OF THE DISCLOSURE

The disclosure relates generally to boat and fishing docks, piers and decks and particular to the marine pilings, such as, but not limited to, those provided on such docks/decks/piers.

2. BACKGROUND

Electricity is non-existent in waterways. As marine docks in the water become safety hazards at nighttime if they are not seen by a boater, it is important to provide some mechanism to alert or inform a boater at night to their existence. The lighting of the deck or dock itself can be costly and also creates new problems based on the corrosive nature of water and electricity. Furthermore, logistical distance often prevents electrical power from being installed on many docks, decks and pilings. Accordingly, the below disclosed piling cap provides a novel device for illuminating one or more pilings, without the need for electrical power to be present at the dock, deck, pier, etc. and in turn may also illuminate the docks, decks, piers, etc. they are associated with during nighttime hours.

SUMMARY OF THE DISCLOSURE

A novel lighted piling cap is disclosed and preferably is a solar powered lighted piling cap or cap/marker for another water borne or water related structure. The device serves as a nighttime marker to alert boaters of decks, docks, waterway obstructions, etc. that may not be visible during nighttime travels. The device can use mil-spec and micro-processor circuitry. Thus, in addition to performing typical duties or task of piling cap, such as, but not limited to being a bird and rain guard, the novel device also includes a lighting element, preferably solar powered, for nighttime visibility. In a preferred embodiment, the lighting element, can be one or more, and preferably a plurality of LED light bulbs, such as high-powered LED lighting. Being preferably solar-powered. the device can be basically maintenance free and easy to install and eliminates need and concern of electrical wiring near the water. The outer enclosure can be constructed from a rugged and/or seaworthy material, to allow it to be able to preferably withstand the harsh environment of fresh and saltwater coastlines. In one non-limiting embodiment, the durable housing can be constructed from a diffused Polycarbonate that can be both impact and U.V. resistant. In two preferred, though non-limiting, embodiments, the device can provide over 200 Lumens of comfortable down light preferably in white or blue light. Though not preferred other light colors can also be selected and are considered within the scope of the disclosure. Preferably, in one embodiment nine (9) durable LED bulbs can be used, though such is not considered limiting and any number (higher or lower) of LED bulbs can be used with the device and all are considered within the scope of the disclosure. In a preferred embodiment, the device also includes a sealed Lithium polymer battery, with flash, strobing and/or on modes, automatic sunset on, sunrise off sensor. Accordingly, the device provides for a novel solar powered lighted piling cap which in addition to provide outdoor light also serves as a nighttime marker to warn boaters of piling and related structure associated with the piling which may not be visible to the boater otherwise and thus otherwise a nighttime water hazard without use of the disclosed novel lighted piling cap.

DETAILED DESCRIPTION

Figure 1:
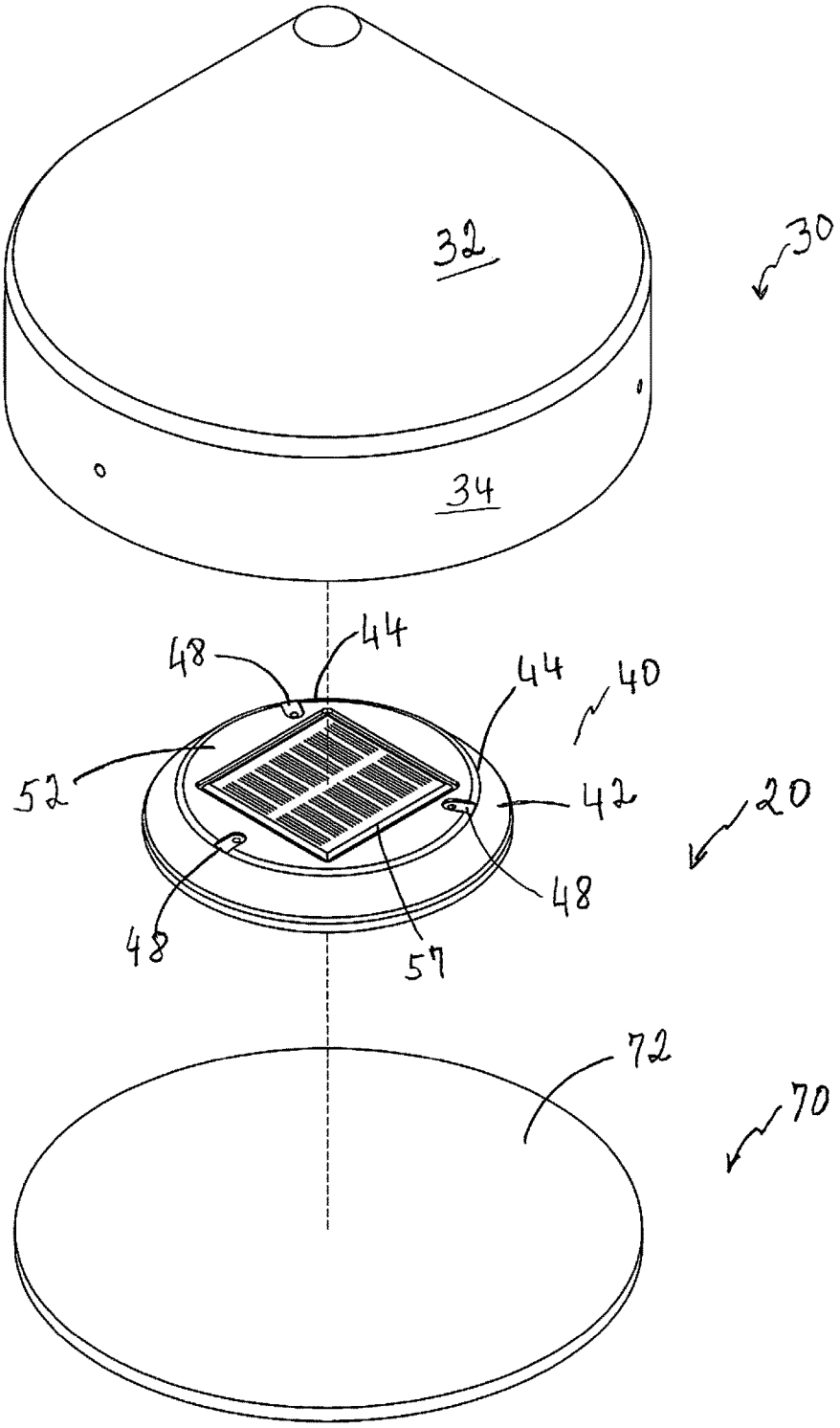
FIG. 1 is an exploded perspective view of one non-limiting embodiment for the novel lighted piling cap in accordance with the present disclosure.
Figure 2:
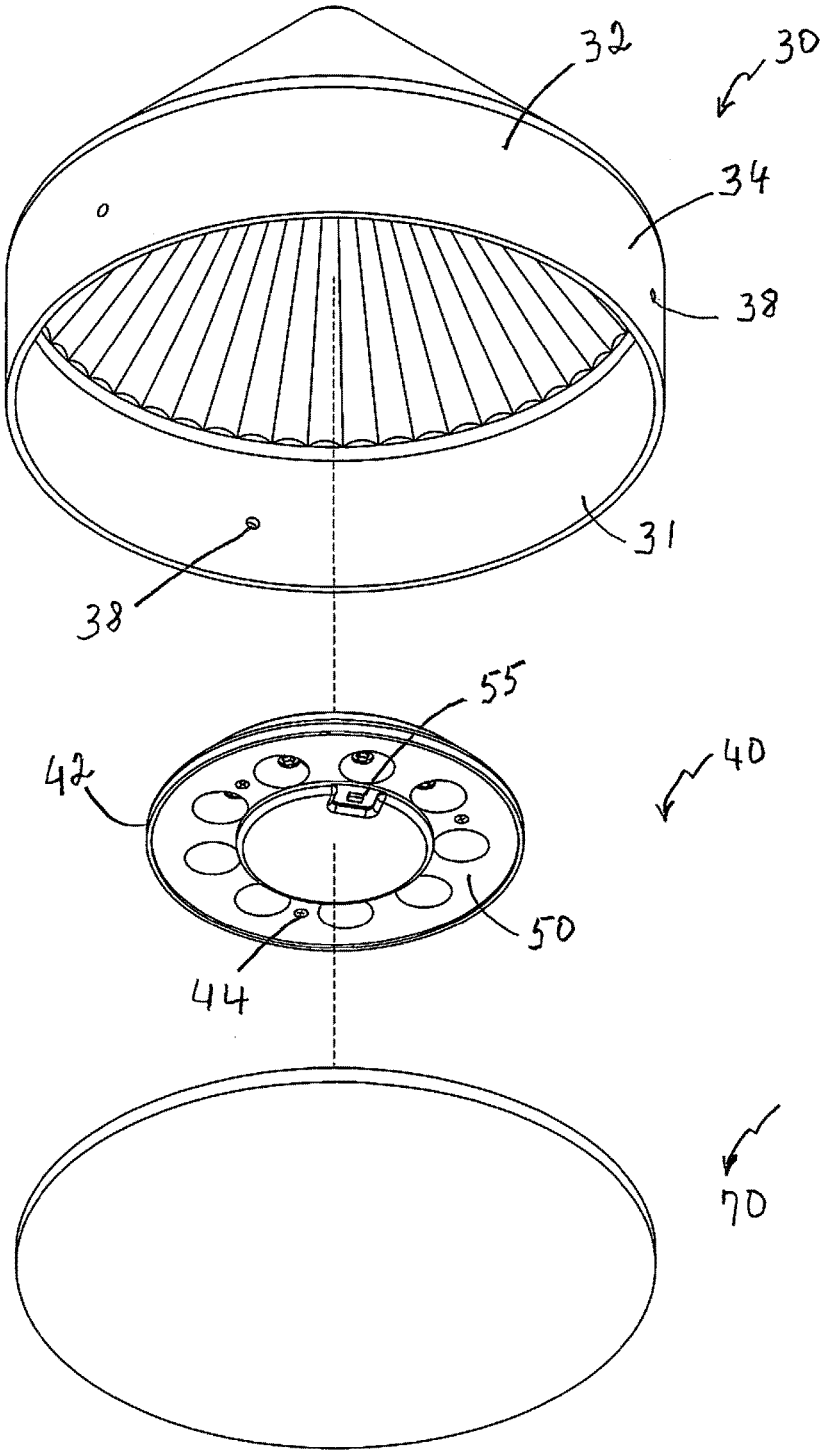
FIG. 2 is another exploded perspective view of the lighted piling cap of FIG. 1.

As seen in the Figures, a novel lighted piling cap or lighting system 20 (collectively "piling cap") is shown. In a preferred embodiment, the pilling cap 20 can be a solar-powered lighted piling cap and can act as a solar-powered lighting system that converts sunlight into energy for power. Charging of the solar-powered lighted piling cap may depend on the location, weather and available light at the location where the device is being used. Light exposure can be a direct correlation to illumination hours. In a preferred use, the device can be installed at least 2 feet about the high-tide water line where the device is being used and is preferably installed on top of a piling or other pole-like object though such is not considered limiting. The floor or lower portion of the device may be silicone-caulked or otherwise sealed in position to help prevent water intrusion. The provided switch should be set to the desired position for intended operation/application (i.e. flashing, strobing, on, etc.) prior to any caulking and final installation. When securing the device to a piling or similar structure the piling/structure may have to be prepped (trimmed, cut, shaved, etc.) to allow the device to properly fit thereto. Additionally, an adhesive material be applied to the piling/structure to help retain the device thereto. The device is equipped and programmed for automatic "on" and "off" based on information received from a dusk/dawn sensor (i.e. light/no or not enough light sensor), once the switch is set for the desired operation. Preferably, the device can be set to a fully on or flashing setting when it is automatically turned on at nighttime from information received from the dusk/dawn sensor. However, other light setting can also be included such as strobing or other patterns in addition to a flashing pattern.

Device 20 can be preferably waterproof and provided with an enclosed design. In one non-limiting embodiment, the solar powered battery can last up to 20 or 25 hours before needing recharging. However, higher and lower length of battery life batteries/systems can be used and are all considered within the scope of the disclosure. The lighting system includes an automatic light sensor and provides a full 360 degrees lighting perimeter. At least the exposed to the elements components of device 20 can be constructed from marine grade materials. Preferably, the lighting system can be solar powered and uses a sealed lithium polymer battery. Some non-limiting uses for the lighted piling cap include as a dock and deck marker, a waterway mark and an obstruction beacon.

Figure 4:
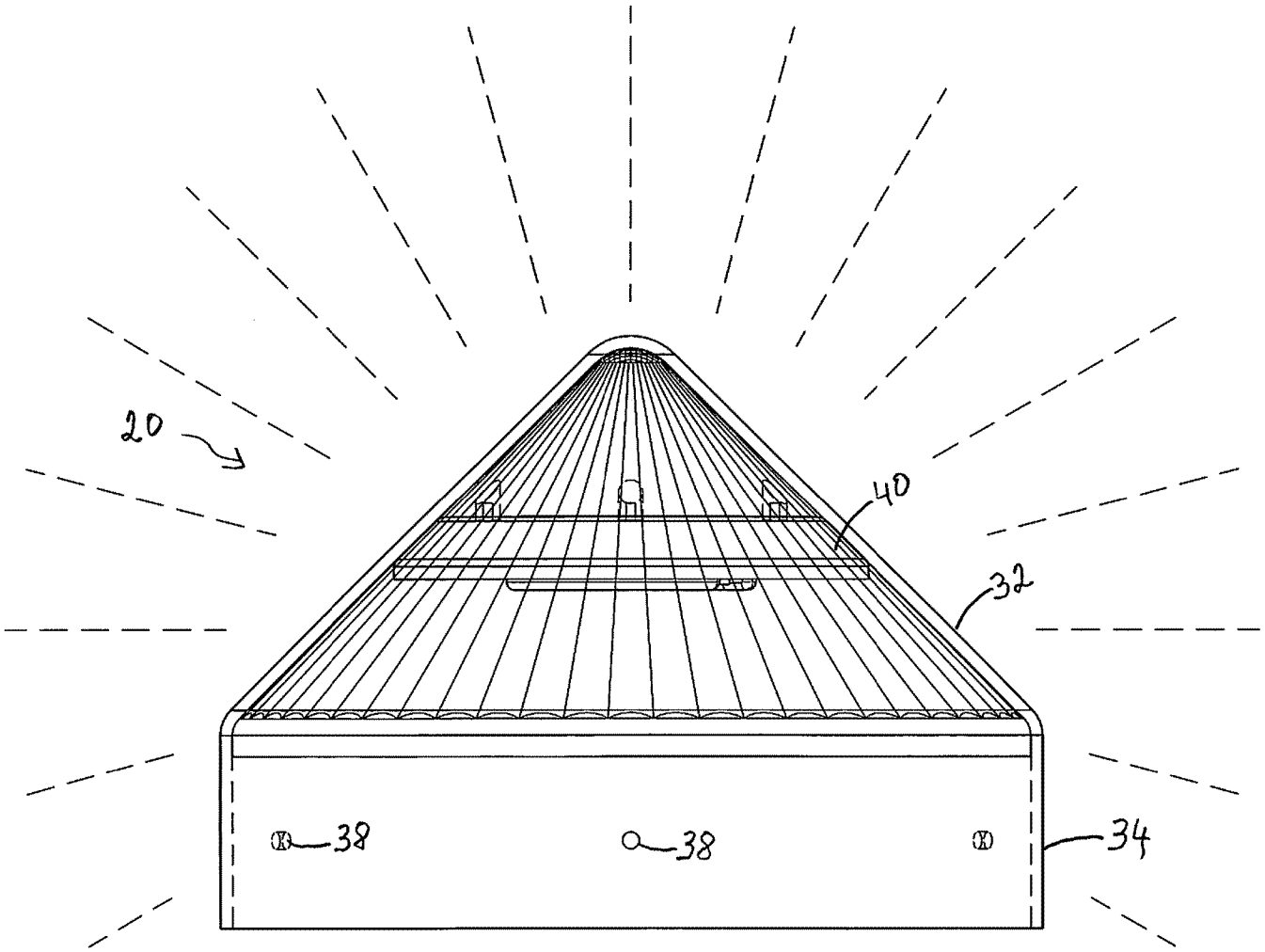
FIG. 4 is a side elevational view of the light piling cap of FIG. 1.
Figure 5:
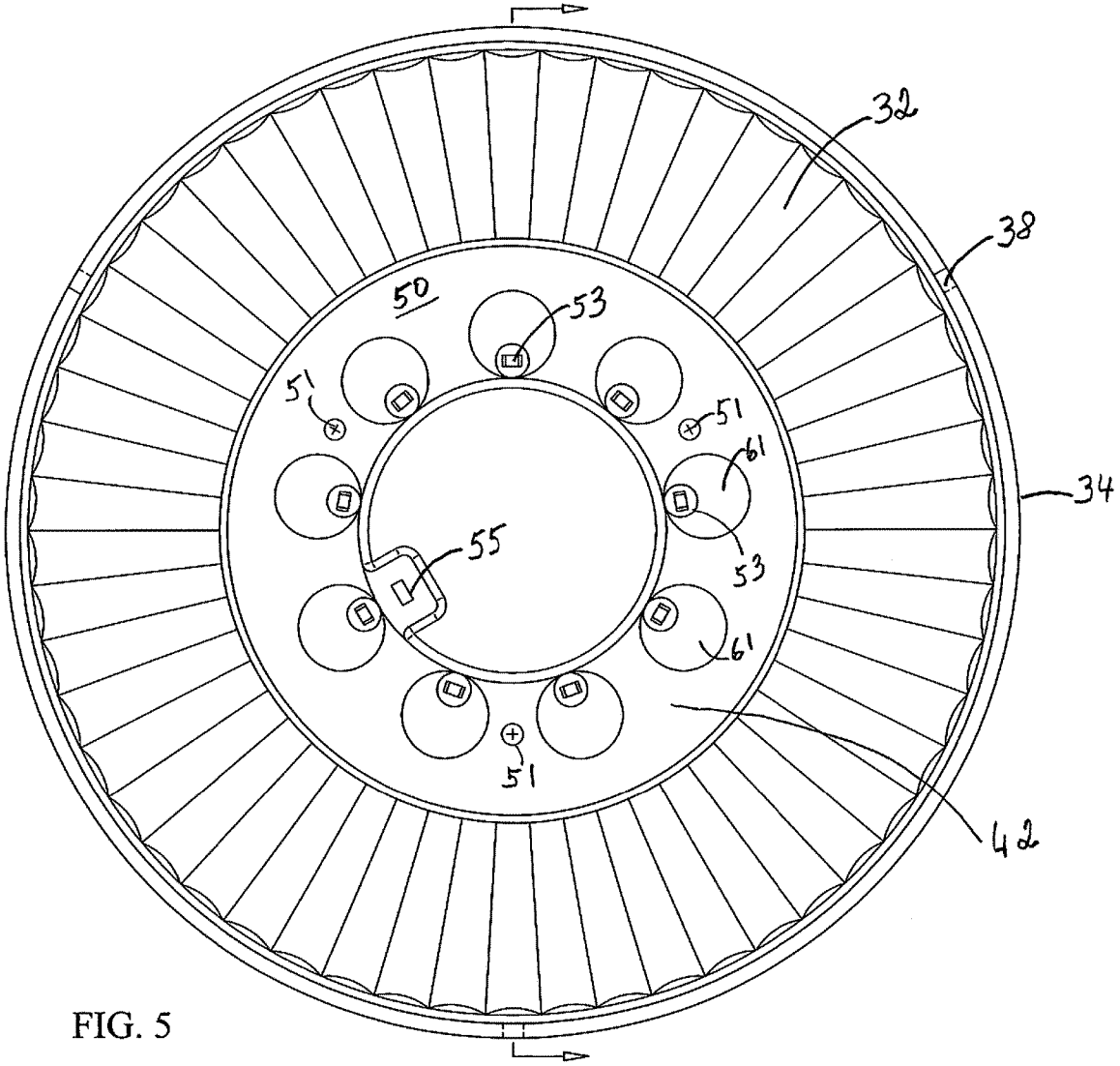
FIG. 5 is a sectional view of the light piling cap of FIG. 1 illustrating the switch which can be used to set the lighted piling cap for a particular light application, such as, but not limited to, flashing or strobing, and to turn the light element of the lighted piling cap on or off.
Figure 6:
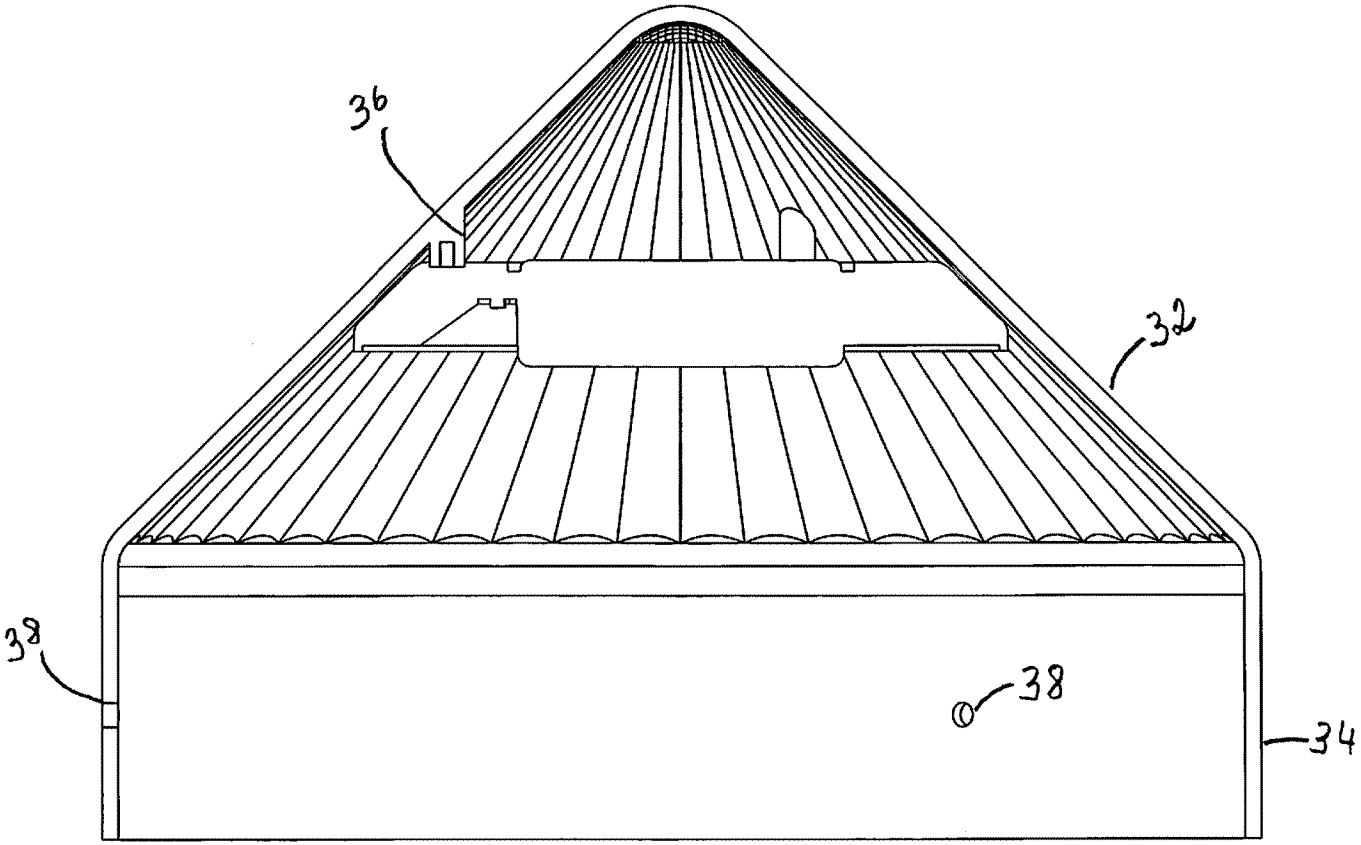
FIG. 6 is a side sectional view of the light piling cap of FIG. 1.

As seen in the figures, the main components of device 20 are shown and include a transparent or translucent enclosure 30 preferably have angled top 32 and a side wall 34 (with top 32 and side wall 34 preferably one piece—constructed integral, monolithically formed, etc.), the electronic/light component 40 and an optional though preferred bottom member or floor/flooring 70. A plurality of pockets 36, preferably threaded, can be provided and preferably extend downward from an inner surface of angled top 32 and are each used to receive and mate with a light retaining bolt/screw (preferably threaded) for mounting electronic/light component 40 within enclosure 30 (See FIG. 4). The electronic housing 42 of component 40 can be provided with a plurality of apertures/passageways 44 with each corresponding to one of a pockets 36. When preferably securing light component 40 to enclosure 30, passageways 44 are aligned with pockets 36 and a mounting screw/bolt is inserted through passageway 44 and into pockets 36 where it is secured, with the head 51 of the bolt/screw positioned against a bottom surface 50 of housing 42. At this point component 40 is securely mounted within enclosure 30. Other mounting techniques and mechanisms can be used and are considered within the scope of the disclosure. To help align passageways 44 with receiving pockets 36, positioning cutouts 48 can be provided on a top surface 52 of housing 40 for receiving the bottoms or outer edges of pockets 36 causing the pocket apertures to be aligned with corresponding passageway 44 to allow easy insertion of the mounting screws/bolts. The mounting screws can be tightened using any ordinary tool, such as, but not limited to, a screwdriver, drill, etc. The preferred solar panels 57 for capturing the sun's energy are shown disposed on top surface 52. The captured energy is used to recharge the rechargeable battery of the electronics that is stored within housing 42. As enclosure 30 is preferably transparent or translucent solar panels 57 are exposed to whatever sun is available during daylight hours despite being covered by enclosure 30 during use and after installation. Preferably, the setting button 55 for changing the light setting (fulling on, flashing, etc.) can be provided on the underside/bottom 50 of housing 42 and is in communication with the electronics stored within housing 42.

A plurality of light sockets 53 are also shown on bottom surface 50 and preferably each is disposed within a cutout or crater 61. A light bulb is connected to each of light socket and in a preferred embodiment the light bulb can be a LED light bulb. Preferably, either a white or blue LED bulbs are used, though other colors can be chosen and are also within the scope of the disclosure. As the light sockets 53 are disposed on bottom surface 50 the LED light bulbs and the light generated can be directed downward towards flooring 70. Though light from device 20 is produce away from device 20, a high intensity portion of the light can be preferably captured or provided at the space between the LED light bulbs and floor 70 and within enclosure 30 to easily mark the piling and/or any water borne structure associated therewith at nighttime, where such structure/piling would not be otherwise visible during nighttime conditions and become a potential safety hazard.

Figure 3:
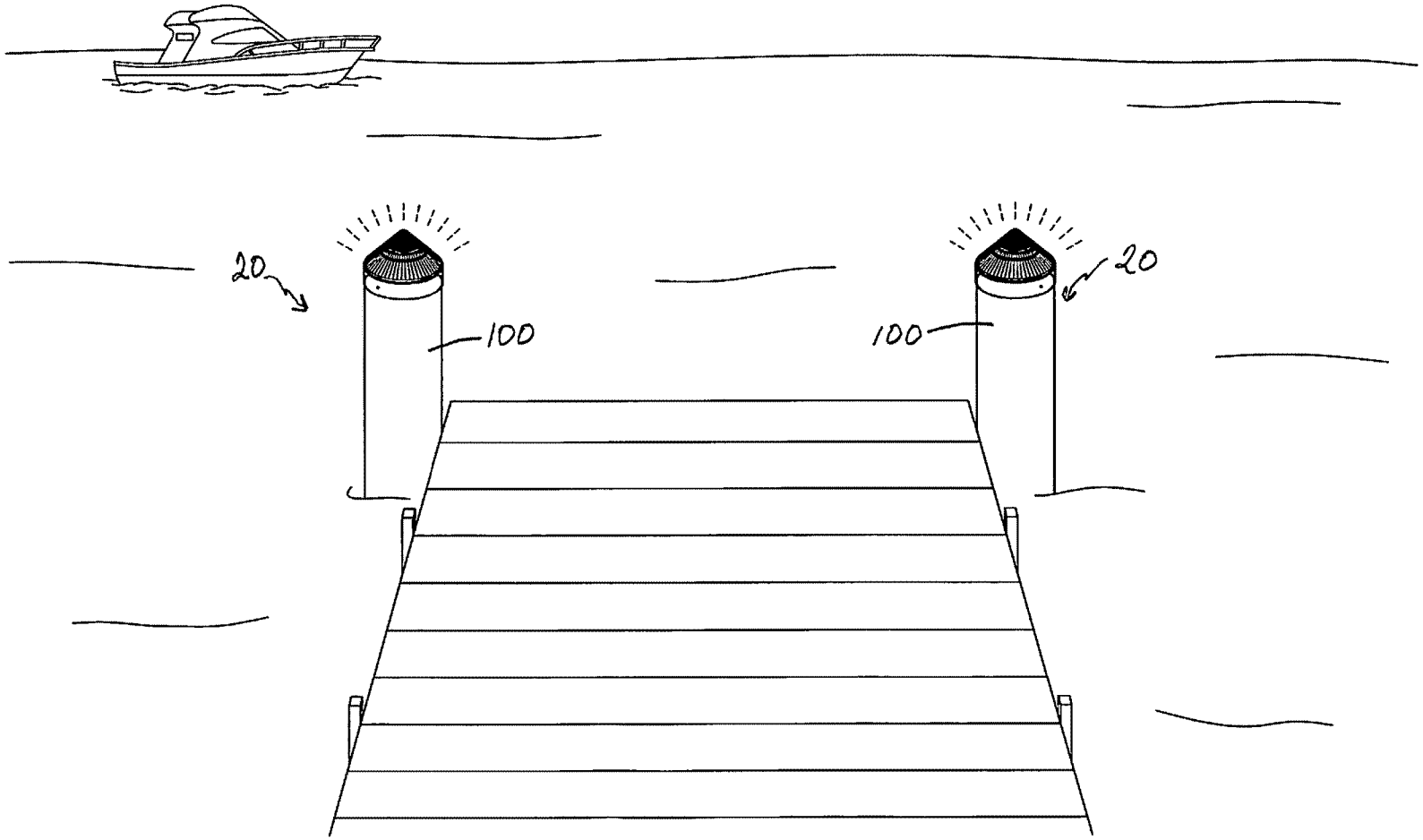
FIG. 3 is a perspective view of a plurality of the novel lighted piling caps of FIG. 1 show in in one non-limiting use on pilings of a dock which in use during nighttime hours illuminate so as to serve as a marker or alert to boaters to help prevent or reduce accidents.

Flooring 70 can be shaped accordingly with the shape of enclosure 30 and can be provided with a reflective, shiny, glossy top or upper surface 72 to help increase the visibility of the light shined down from light component 40 (discussed further below). It is within the scope of the disclosure that device 20 be provided without flooring 70 and that the light coming from light component is sufficient for being visible at night without having its intensity or nighttime visibility enhanced through the characteristics of upper surface 72. Alternatively, it also within the scope of the disclosure that no flooring 70 is included and similar characteristics to those of upper surface 72 can be painted or otherwise applied to the top of the piling that device 20 is to be secured thereto. Enclosure 30 can also be provided with a plurality of apertures 38 located at certain locations (preferably equally spaced apart or just spaced apart from each other). When securing device 20 to the piling, preferably light component 40 is mounted within enclosure 30 and if provided flooring 70 is disposed on the top of the piling. Enclosure 30 is positioned over flooring 70 and side wall 34 extends along the top of the piling. Mounting screws or other attachment devices can then be inserted through the enclosure apertures 38 and driven into piling such as by screwdriver, drill etc. At this point, device 20 is securely attached at the top of the piling 100 (See FIG. 3) and the light it produces can serve as a safety marker at night.

Device 20 can also serve as a piling cap. As discussed above enclosure 30 can be preferably translucent or transparent and houses a solar panel and light assembly 40. Assembly 40 can preferably be provided with a dusk to dawn light sensor, multiple lights bulbs (preferably LED lights). The solar panel can be a high efficient solar panel 57. In one non-limiting embodiment, 9 LED bulbs/sockets can be provided though such number is not considered limiting and LED bulbs/sockets can be used, and all are considered within the scope of the disclosure.

The bottom opening of enclosure 30 can be sized and/or shaped to provide a tight/secure fit to the top of the piling or other intended structure it is to be secured to. Alternatively, or in addition to the tight fit, one or more fastening holes 38 can be provided through the lower area/side wall 34 of enclosure 30 for insertion of a screw, bolt, etc. for securing the enclosure 30 to the piling or other structure. Adhesives applied to the piling/structure and/or inside surface of side wall 34 can also be used in addition to or as an alternative securement mechanism. Preferably side wall 34 can be shaped according to the shape of the top of the piling/structure to allow the top of the piling to easily mate with the bottom opening of enclosure 30. In one non-limiting embodiment, the shape of side wall 34 and the enclosure bottom opening 31 defined by side wall 34 can be circular, round, oval, etc. in shape though other shapes can be used and are considered within the scope of the disclosure.

The solar panel and light assembly electronics and battery can be secured internally within housing 42 by any conventional means with the solar panels disposed on the top of housing 42. The disclosure is not considered limited to any particular color LED bulbs and all colors or no color bulbs can be used and are considered within the scope of the disclosure. Conventional wired and wireless communications/connections can be used for electronically linking connecting the various electronic/electric components used for the lights, charging, solar collecting, and power.

In one non-limiting embodiment for the solar panel and light assembly, electricity can be generated by the solar panel and collected and stored in a capacitor and battery. In one non-limiting embodiment, the battery can be a lithium polymer type, though other batteries can be used and are all considered within the scope of the disclosure. Preferably, the battery can be charged during daylight hours. When no sunlight is present (such as at nighttime), a dusk to dawn sensor can be activated or send information to circuitry/electronics to automatically turn on the light on, using the energy from the battery. In one non-limiting embodiment, the light can be multiple light emitting diodes (LEDs) that can be provided in pattern, such as a circular pattern, and can positioned at a specific angle or extend downward from the bottom surface 50 of housing 42. Light from the LEDs illuminates the preferred transparent shell/outer housing and can also be visible from a distance and can be enhanced by top surface 72 of flooring 70 when provided.

The outer shell/enclosure 30 can be constructed from an impact resistant Polycarbonate or Triton plastic material, to preferably give a glass like appearance and clarity. However, the disclosure is not considered limited to such materials, and other materials can also be used and are considered within the disclosure. Though not limiting, it is preferred that a translucent or transparent be used for constructing the outer shell/enclosure 30 to allow exposure to the sun for the one or more solar panels 57.

Piling cap 20 also helps to reduce or prevent swelling of the piling 100. Providing the light with or as part of the piling cap 20 helps to identify obstructions in the water during nighttime hours to help reduce or prevent accidents. Lighting the pilings 100 with the disclosed lighted piling caps 20 also increases safety and navigation for boaters during nighttime hours.

Preferably, the enclosure/shell 30 can fit over the top of piling 100 entirely, which helps to protect piling 100 from water intrusion. Lighting the piling location through the disclosed novel lighted piling cap 20, also serves as a safety marker, to help reduce or prevent individuals and animals from falling in the water, as the lighted piling caps can mark decks, docks, piers, etc. they are associated with.

A motion sensor can also be provided and in communication with the electrical/electronic components. The motion sensor can provide additional security, and can be used to turn the light on and/or to dimly lit piers, decks and docks of waterfront property.

In addition to the above disclosed LEDs lights or in place of, U.S. Coast Guard approved navigational lights can be used as further protections for the disclosed solar powered lighted piling cap from the elements.

As mentioned above, in use lighted cap 20 preferably fits over the top of a piling 100 (See FIG. 3), which also serves to help protect such piling 100 from water intrusion into the end grain of the piling 100.

The angled shape of the top portion 34 of enclosure 30 (i.e. pyramid or dome), allows the novel lighted piling cap to also act as a bird deterrent and allow rain to run off and not accumulate on the piling cap 20 or piling 100.

When the light is on, the novel lighted piling cap 20 helps to light obstructions, the pilings, the dock or deck at nighttime, which also provides security benefits to the area.

The angle for top portion 32/slope of enclosure 30 is not considered limited to any particular angle and various angles can be selected and used.

The disclosed novel lighted piling cap can also be used with poles, posts and other vertically extending objects (collectively referred to as "Pilings" or "pilings" herein) found on marine docks, decks, piers, as well as Pilings extending up out of the water, and such other uses are also considered within the scope of the disclosure.

Figure 7:
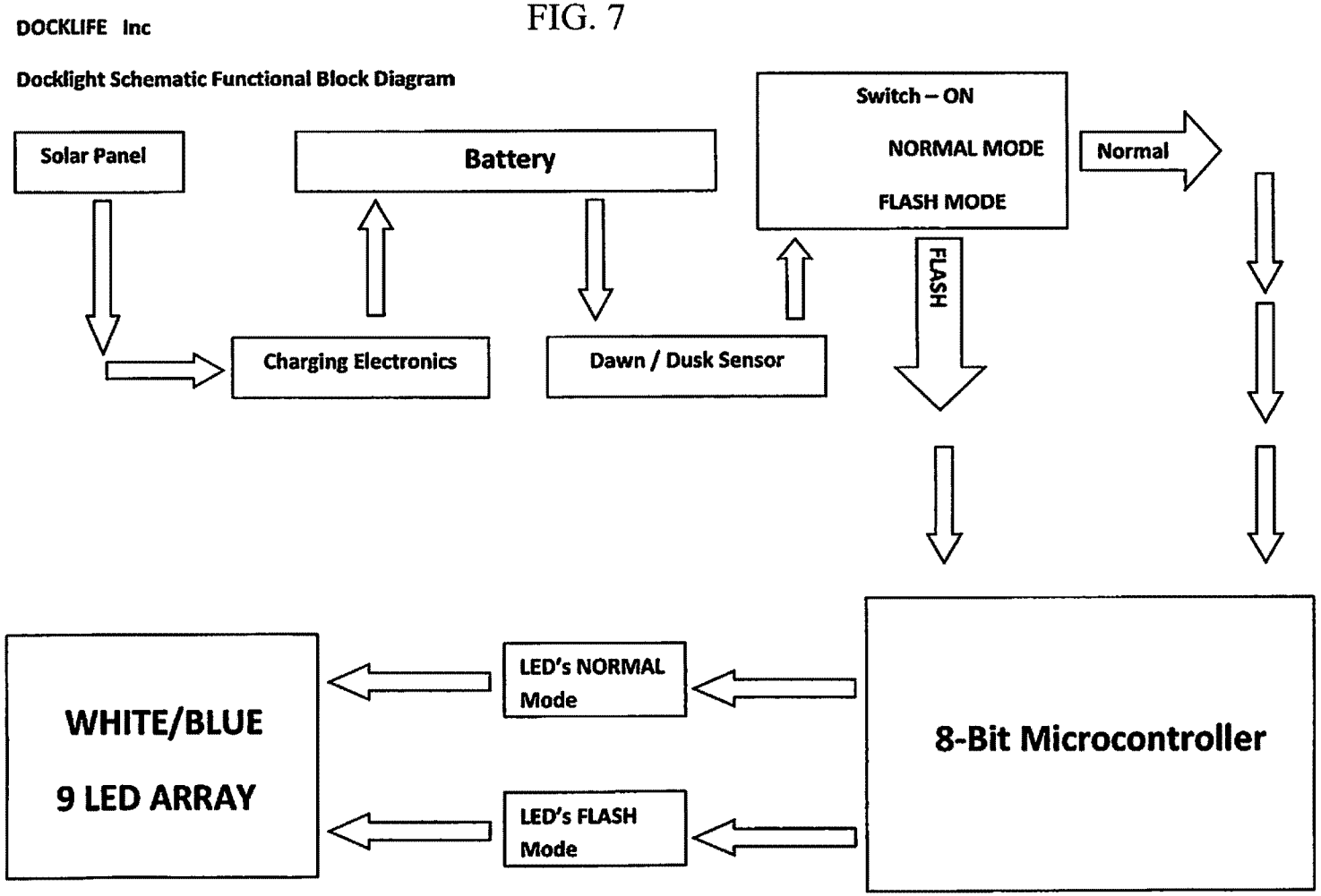
FIG. 7 is a non-limiting schematic/block diagram for one embodiment of the main electronic components for the novel lighted piling cap in accordance with the present disclosure.

FIG. 7 illustrates a schematic for the electronics/electrical circuitry primarily safely disposed and protected within housing 42. The output from solar panel 57 provides the main charging source potential for the unit. The battery can preferably charge any time Solar Panel 57 is active. Dusk to Dawn detection circuitry gates off the battery to the unit while the unit is in charging mode. At Dusk, the Dusk to Dawn sensor allows, or provides the "time of day" information to cause, battery connection to the unit. A DPDT Switch can provide preferably three non-limiting operational modes: a). NORMAL—LED's ON; b); FLASH—LED's Flash at a preprogrammed rate; and c). OFF—Unit is OFF. The setting that is chosen can be controlled or selected by the user such as by pressing button 55 prior to installing device 20 on a piling.

In the preferred embodiment, the microcontroller is active in either NORMAL or FLASH modes. The LED array can consist of an array of nine LED's (in one non-limiting embodiment) and are driven by the microcontroller.

Figure 8:
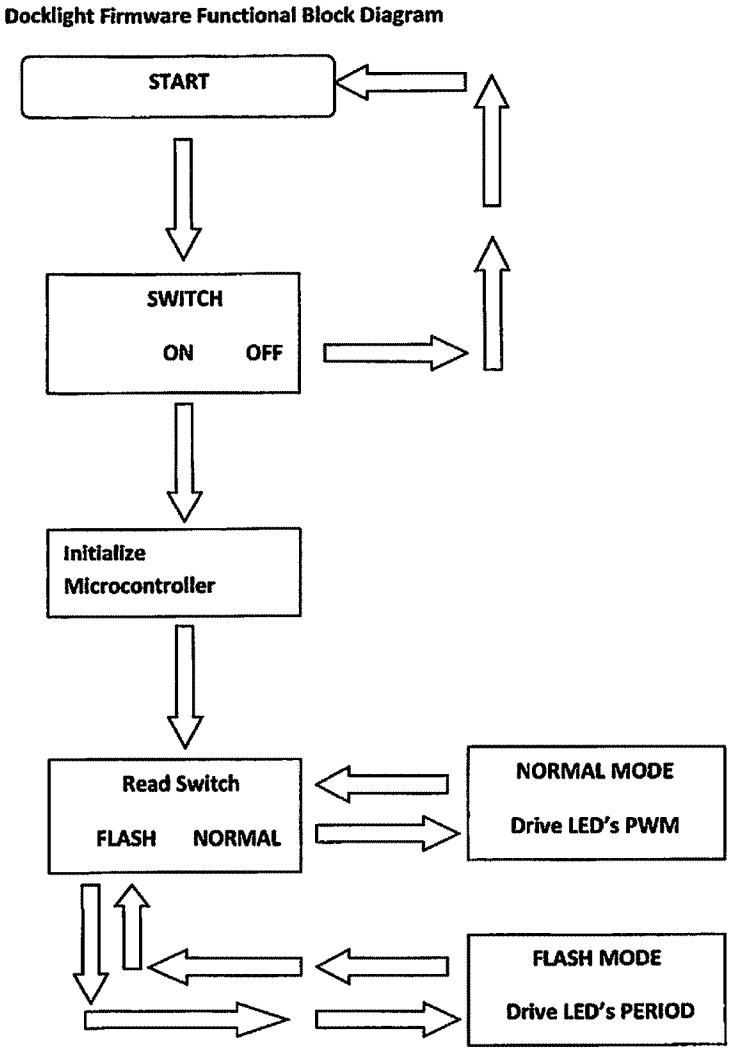
FIG. 8 is a non-limiting functional block diagram/process flow used for operation of the novel lighted piling cap in one embodiment in accordance with the present disclosure.

FIG. 8 illustrates a process flow of certain software/firmware. With SWITCH ON: the following steps can be performed:

1. Initialization of the Microcontroller. Initialize all GP Ports.
2. Initialize all PWM algorithms.
3. Initialize all Periodic algorithms.
4. Read the Switch. Determine switch position.
5. If switch is in NORMAL Mode:
   a). Perform PWM algorithm and drive LED with preset time settings.
6). If Switch is in FLASH Mode
   a). Perform Periodic algorithm and drive LED with preset time settings.
7). Read the Switch.

In a preferred embodiment device 20 can be impact resistant, and have water tight/clear enclosure, embedded electronics and a Lithium polymer battery.

In a preferred though non-limiting embodiment, device 20 can have the following characteristics:

Operation: •
Light Colors; Blue and White
Illumination; 22 Hrs. on Full Charge •
On-Off; Automatic with sunrise/ sunset •
Visibility; 2 Nautical miles on Flash mode •
Field of View; 360 degrees •
Rating; IP65
—
Enclosure:
Sizes; 9 inch standard, will accommodate 7 ¾ to 9 in. piling.
Material; Impact and U.V. Resistant Polycarbonate blend •
Clarity; Water clear, diffused •
Life expectancy; 10 yrs.
Performance; •
Output; 200 Lumens •
Modes; On, Off, Flash •
LED life rating; 10 yrs. •
Battery; Sealed Lithium Polymer, (replaceable) •

Protection; IC controlled with overcharge, undercharge and output control.

All installation hardware can also be included

Though above characteristics are provided by way of example only and are not considered limiting and other characteristics, features, ratings, dimensions, values, etc. can be used and are also considered within the scope of the disclosure.

It should be understood that the exemplary embodiments described herein should be considered in a descriptive sense only and not for purposes of limitation. Where multiple embodiments are disclosed, descriptions of features or aspects within each embodiment should typically be considered as available for other similar features or aspects in other embodiments. While one or more embodiments have been described with reference to the figures, it is understood that various changes in form and details may be made therein without departing from their spirit and scope and such changes are considered within the scope of the disclosure.

All parts/components of the lighted piling cap and their locations, wiring, solar powering means, mechanical and/or electrical communications between parts/components, attachment or securement mechanisms, dimensions, values, ratings, shapes, materials, etc. discussed above or shown in the figures, if any, are merely by way of example and are not considered limiting and other component(s) and their locations, wiring, solar powering means, mechanical and electrical communications between parts/components, attachment or securement mechanisms, dimensions, values, ratings, shapes, materials, etc. can be chosen and used and all are considered within the scope of the disclosure.

The benefits, advantages, solutions to problems, and any element(s) that may cause any benefit, advantage, or solution to occur or become more pronounced are not to be construed as a critical, required, or essential features or elements of any or all the future claims.

All components of the described system and their locations, shapes, electrical connector types, electrical communication methods, electrical stimulation methods, moving mechanisms, movement pattern, motors, dimensions, sizes, lengths, configurations, positions, securement and attachment techniques and methods, materials, etc. discussed above or shown in the drawings, if any, are merely by way of example and are not considered limiting and other component(s) and their locations, shapes, electrical connector types, electrical communication methods, electrical stimulation methods, moving mechanisms, movement pattern, motors, dimensions, sizes, lengths, configurations, positions, securement and attachment techniques and methods, materials, etc. can be chosen and used and all are considered within the scope of the disclosure.

While the novel lighted piling cap has been described and disclosed in certain terms and has disclosed certain embodiments or modifications, persons skilled in the art who have acquainted themselves with the disclosure, will appreciate that it is not necessarily limited by such terms, nor to the specific embodiments and modification disclosed herein. Thus, a wide variety of alternatives, suggested by the teachings herein, can be practiced without departing from the spirit of the disclosure, and rights to such alternatives are particularly reserved and considered within the scope of the disclosure.

What is claimed is:

1. A lighted piling cap for alerting individuals of a location of a piling that the lighted piling cap is secured to during nighttime conditions where the piling is not visible to the individuals, comprising:

an enclosure adapted for securement to the top of a piling, the enclosure including an angled top member and sidewall extending downward from the angled top member; and a light assembly having at least one light bulb, the light assembly mounted within the enclosure solely to the angled top member at an intermediate point between a top end and a bottom end of the angled top member; and a power source for energizing the light assembly;

wherein during nighttime conditions when the light assembly is on the light from the at least one light bulb serves as a marker for the piling where the piling may not be visible or easily seen.

2. The lighted piling cap of claim 1 wherein the enclosure is transparent or translucent.

3. The lighted piling cap of claim 2 wherein the at least one light bulb is a plurality of LED light bulbs that extend downward when the light assembly is mounted within the enclosure to the angled top member; the light assembly having a light housing having an upper surface and a bottom surface, the bottom surface of the light housing having a plurality of cutouts with each LED light bulb of the plurality of LED light bulbs disposed within a corresponding one cutout from the plurality of cutouts; wherein each LED light bulb extends downward with respect to the light housing.

4. The lighted piling cap of claim 3 wherein the power source is a rechargeable battery; wherein in use the plurality of LED light bulbs are hidden from view within the plurality of cutouts when viewing the enclosure from a side view.

5. The lighted piling cap of claim 4 wherein the light assembly including solar recharging circuitry for recharging the rechargeable battery and one or more solar panels for collecting energy from the sun during daytime conditions which is converted to energy for recharging the rechargeable battery; wherein the one or more solar panels are disposed on the upper surface of the light housing.

6. The lighted piling cap of claim 1 further comprising a light sensor in communication with the light assembly; wherein information from the light sensor is used to determine when to automatically turn on the at least one light bulb by the light assembly.

7. The lighted piling cap of claim 1 further comprising a flooring member that is adapted for disposal on and contact with a top surface of the piling and is located within the enclosure at a point where the bottom end of the angled top member meets a top end of the sidewall, wherein the flooring member is a separate member from the light assembly.

8. The lighted piling cap of claim 7 wherein the flooring member having a shiny, reflective or glossy top surface.

9. The lighted piling cap of claim 8 wherein the enclosure having a side wall that extends along the piling when the enclosure is secured to the piling and in the secured position a space is created between the flooring member and the light assembly within the enclosure; wherein when the at least one light bulb is "on" during nighttime conditions a highest intensity area of the light is disposed within the space.

10. The lighted piling cap of claim 1 wherein the angled top member having a plurality of pockets disposed within the enclosure with each pocket having an opening and the light housing having a plurality of apertures extending therethrough; wherein when mounting the light assembly within the enclosure each light housing aperture is aligned with a corresponding pocket opening and a fastening member is inserted into and within each aligned aperture/pocket opening for retaining the light assembly mounted to the enclosure.

11. A solar powered lighted piling cap for alerting individuals of a location of a piling that the lighted piling cap is secured to during nighttime conditions where the piling is not visible to the individuals, comprising:

an enclosure having a dome or pyramid shaped top portion and a sidewall extending downward from a lower end of the top portion;

a lighting and rechargeable system housing having a top surface and a bottom surface, the housing mounted solely to the top portion of the enclosure and within the enclosure at an intermediate point between a top end and a lower end of the top portion; the bottom surface of the light and rechargeable system housing having a plurality of cutouts; a plurality of LED light bulbs extending downward from the bottom surface of the housing, each LED light bulb of the plurality of LED light bulbs disposed within a corresponding one cutout from the plurality of cutouts; wherein each LED light bulb extends downward with respect to the light housing;

lighting and recharging circuitry disposed within the housing;

at least one solar panel disposed on the top surface of the housing and in communication with the lighting and recharging circuitry;

a light sensor disposed on the housing and in communication with the lighting and recharging circuitry;

a rechargeable battery disposed within the housing and in communication with the lighting and recharging circuitry;

wherein the at least one solar panels collects energy from the sun during daytime conditions which is used by the lighting and recharging circuitry for recharging the rechargeable battery;

wherein information from the light sensor is used to determine when to automatically turn on the plurality of LED light bulbs by the lighting and recharging circuitry;

wherein in use the plurality of LED light bulbs are hidden from view within the plurality of cutouts when viewing the enclosure from a side view.

12. The solar powered lighted piling cap of claim 11 further comprising a switch in communication with the lighting and recharging circuitry for setting a light pattern for the plurality of LED light bulbs when the plurality of LED light bulbs are automatically turned on by the lighting and recharging circuitry, the switch disposed at the bottom surface of the light and rechargeable system housing.

13. The solar powered lighted piling cap of claim 12 wherein the light pattern is fully on, flashing or strobing.

14. The solar powered lighted piling cap of claim 11 wherein the enclosure is constructed from a transparent or translucent materiel to increase exposure of the at least one solar panel with the sun during daytime conditions.

15. The solar powered lighted piling cap of claim 11 further comprising a flooring member that is adapted for disposal on and contact with a top surface of the piling and is located within the enclosure at a point where the lower end of the top portion meets a top end of the sidewall, wherein the flooring member is a separate member from the lighting and rechargeable system housing.

16. The solar powered lighted piling cap of claim 15 wherein the flooring member having a shiny, reflective or glossy top surface.

17. The solar powered lighted piling cap of claim 16 wherein the sidewall is positioned along the piling when the enclosure is secured to the piling and in the secured position a space is created between the flooring member and the plurality of LED light bulbs within the enclosure; wherein when the plurality of LED light bulbs at least one light bulb is "on" during nighttime conditions a highest intensity area of the light from the bulbs is disposed within the space.

18. The lighted piling cap of claim 11 wherein the top portion having a plurality of pockets disposed within the enclosure with each pocket having an opening and the lighting and rechargeable system housing having a plurality of apertures extending therethrough; wherein when mounting the lighting and rechargeable system housing within the enclosure each housing aperture is aligned with a corresponding pocket opening and a fastening member is inserted into and within each aligned housing aperture/pocket opening for retaining the lighting and rechargeable system housing mounted to the enclosure.

19. A method for alerting a boater of an existing or a piling or other water borne structure that is not visible to the boater during nighttime conditions, comprising the steps of:

a. securing a piling cap to a top area of the piling or other water borne structure, the piling cap comprising an enclosure, a light assembly and a power source for energizing the light assembly, the enclosure having an angled top member and sidewall extending downward from the angled top member; the light assembly having at least one light bulb extending downward and mounted within the enclosure solely to the angled top member at an intermediate point between a top end and a bottom end of the angled top member;

b. causing the at least one light bulb to turn on during nighttime conditions; and c. providing enough light from the light bulb such that the boater is able to see the light from a distance and be alerted to the existence of the piling or other water borne structure so as to avoid running into the piling or other water borne structure.

20. The method for alerting a boater of claim 19 further comprising the steps of: providing a rechargeable power source for powering the light element and recharging the power source during daytime conditions.

21. The method for alerting a boater of claim 20 wherein the step of recharging the power source comprises the steps of: providing a solar panel and using solar power to recharge the power source.

22. The method for altering a boater of claim 19 wherein step b comprises the steps of: providing a light sensor and using information receive the light sensor to turn on the light element when the information indicates that is currently a nighttime condition.

* * * * *